United States Patent [19]

Grehier et al.

[11] Patent Number: 4,898,233

[45] Date of Patent: Feb. 6, 1990

[54] HEAT EXCHANGE DEVICE USEFUL MORE PARTICULARLY FOR HEAT EXCHANGES BETWEEN GASES

[75] Inventors: Alain Grehier, Paris; Alexandre Rojey, Garches, both of France

[73] Assignee: Institut Francais Du Petrole, Rueil-Malmaison, France

[21] Appl. No.: 216,466

[22] Filed: Jul. 7, 1988

Related U.S. Application Data

[62] Division of Ser. No. 855,034, Apr. 23, 1986, Pat. No. 4,771,826.

[30] Foreign Application Priority Data

Apr. 23, 1985 [FR] France ..... 8506297

[51] Int. Cl.[4] ..... F28F 3/02; F28F 3/08

[52] U.S. Cl. ..... 165/166; 165/906

[58] Field of Search ..... 165/166, 906

[56] References Cited

U.S. PATENT DOCUMENTS

| | | | |
|---|---|---|---|
| 1,662,870 | 3/1928 | Stancliffe | 165/166 |
| 1,899,080 | 2/1933 | Dalgliesh | 165/166 X |
| 1,969,766 | 8/1934 | Samsvik | 165/166 X |
| 2,529,013 | 11/1950 | Gloyer | 165/166 |
| 2,814,470 | 11/1957 | Peterson | 165/166 X |
| 2,846,197 | 8/1958 | Berg et al. | 165/166 |
| 2,985,434 | 5/1961 | Boring et al. | 165/166 |
| 3,148,442 | 9/1964 | Gier, Jr. | 165/166 X |
| 3,587,731 | 6/1971 | Hays | 165/166 X |
| 4,130,160 | 12/1978 | Dziedzic et al. | 165/166 |
| 4,749,032 | 6/1988 | Rosman et al. | 165/166 X |

FOREIGN PATENT DOCUMENTS

| | | | |
|---|---|---|---|
| 398796 | 5/1922 | Fed. Rep. of Germany | 165/166 |
| 962407 | 6/1950 | France | 165/166 |
| 1185469 | 3/1970 | United Kingdom | 165/166 |

*Primary Examiner*—Carl D. Price

*Attorney, Agent, or Firm*—Milllen, White & Zelano

[57] ABSTRACT

A heat exchange device is provided whose exchange zone is formed by juxtaposing a plurality of plates parallel with each other and spaced apart two-by-two by a plurality of spacing elements consisting of spacers parallel to each other, which may be crenellated (they then comprise crenels and projecting parts) or continuous, said plates being formed so that for any two adjacent plates, at least one of the facing faces is provided with spacers, at least one part of said spacers being, over at least a part of their length, in contact with the facing face of the adjacent plate or with at least a part of the spacers possibly present on said facing face, over at least a part of their length, said plates, defining flow spacers for two fluids being further formed and disposed so that for one flow space out of two the spacers carried by at least one of the facing faces of two adjacent plates defining said space are crenellated spacers. The fluids flow advantageously in cross-current relation. The heat exchange devices thus formed, whose plates may be obtained readily by molding (light alloys, thermpolastic materials or thermosetting materials) are advantageously used for exchanges between gases, for example for recovering heat from the smoke of boilers or furnaces.

2 Claims, 11 Drawing Sheets

HEAT EXCHANGE DEVICE USEFUL MORE PARTICULARLY FOR HEAT EXCHANGES BETWEEN GASES

This is a division, of application Ser. No. 06/855,034 filed Apr. 23, 1986 now U.S. Pat. No. 4,771,826.

BACKGROUND OF INVENTION

1. Field of Invention

The invention relates to a heat exchanger of modular structure usable more particularly for heat exchanges between gases.

2. Description of the Prior Art

The applicant has already previously described different heat exchange devices of modular structure, for example, in the French published applications FR A Pat. No. 2 530 798 and 2 541 442. The devices described in these documents were formed of a stack of grids (or lattices) assembled one above the other by rabbeting, these grids being obtained by injection molding of the thermoplastic materials (metals or synthetic resins) or formed by assembling strips together, themselves obtained by machining or by injection molding different thermoplastic materials. When the strips or dividing walls forming the stacked grids had no perforations, according to a particular type of exchange structure, the said superimposed strips or dividing walls formed separate channels in which fluids taking part in the exchange, could flow, for example in alternate rows of channels, the fluids considered then flowing n parallel currents (in co-current or counter-currentwise).

In another type of exchange structure, some of the strips or dividing walls, in particular one of the strip or dividing wall assemblies disposed parallel to one another could also comprise perforations, creating between the channels of the same row communications allowing one of the fluids to flow in a direction substantially perpendicular to the strips or dividing walls thus pierced, so in a direction substantially perpendicular to that of the channels through which the other fluid flows. In this case, the exchanger could operate with crossed currents.

A particular embodiment described consisted of a three-block exchanger, comprising a central block with parallel currents (for example, counter-current) corresponding to a structure of the first type above and two end-blocks corresponding to a structure of the second type above and serving for the intake and the discharge of the fluids. The heat exchangers thus formed could be used more particularly for recovering heat by air introduced (and removed) laterally through the end-blocks in communicating channel networks, from the smoke which passed through the end-blocks through rows of separate channels. Another embodiment could consist of a single block corresponding to a structure of the second type above, such a structure being intended to operate with crossed currents.

New heat exchangers of modular structure have now been perfected whose constituent elements, consisting of plates having spacers which will be describe further on are even easier to manufacture, for example by injection molding, than the grids (or lattices) forming the above described exchangers. Another advantage of the exchangers of the invention resides in the considerable reduction in the possibility of one fluid leaking to the other, as will be explained further on in the detailed description of the invention.

SUMMARY OF THE INVENTION

Generally, the invention provides a device for the heat exchange between a relatively hot fluid and a relatively cold fluid, which comprises an exchange zone and intake and discharge means for each of the said fluids, the said exchange zone comprising at least one block formed by juxtaposition of the plurality of plates parallel with one another, each plate being provided on at least one of its faces with spacer elements consisting of continuous or crenellated spacers, parallel with one another on the same plate and from one plate to another, these plates being formed and disposed so that, for any two adjacent plates, at least one of the facing faces is provided with spacers, at least a part of such spacers being, over at least a part of their length, in contact with the face of the adjacent facing plate, or with at least a part of the spacers possibly present on said facing face, over at least a part of their length; the plates, thus juxtaposed so as to define flow spaces for said fluids, being further formed and disposed, so that for one flow space out of two, the spacers carried by at least one of the facing faces of the two adjacent plates defining said space are crenellated spacers.

In what follows, the crenellated spacers may also be called "indented" (the terms "crenel" and "indentation" will be used indifferently). The continuous spacers may also be called "solid". Preferably, the plates whose juxtaposition forms the exchange zone of the devices of the invention are rectangular and the spacers which they carry (whether they are crenellated or continuous) are parallel to the homologous edges of the assembly of said plates.

BRIEF DESCRIPTION OF DRAWINGS

The invention will be described with reference to the accompanying figures in which :

- FIGS. 1OA and 1OB show schematically two possible modes of operation of exchanger structures in accordance with the invention;

DESCRIPTION OF THE PREFERRED EMBODIMENTS

Figure 1:
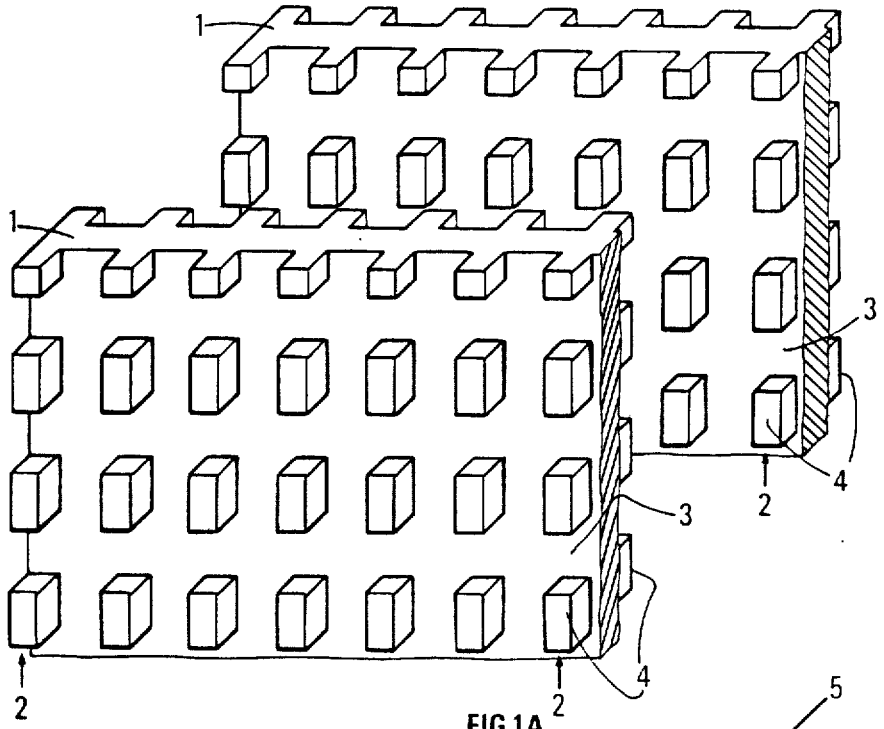
- FIG. 1 shows a perspective view of two portions of adjacent plates corresponding to a first particular embodiment, in which each plate carries on both its faces parallel indented spacers.
Figure 11:
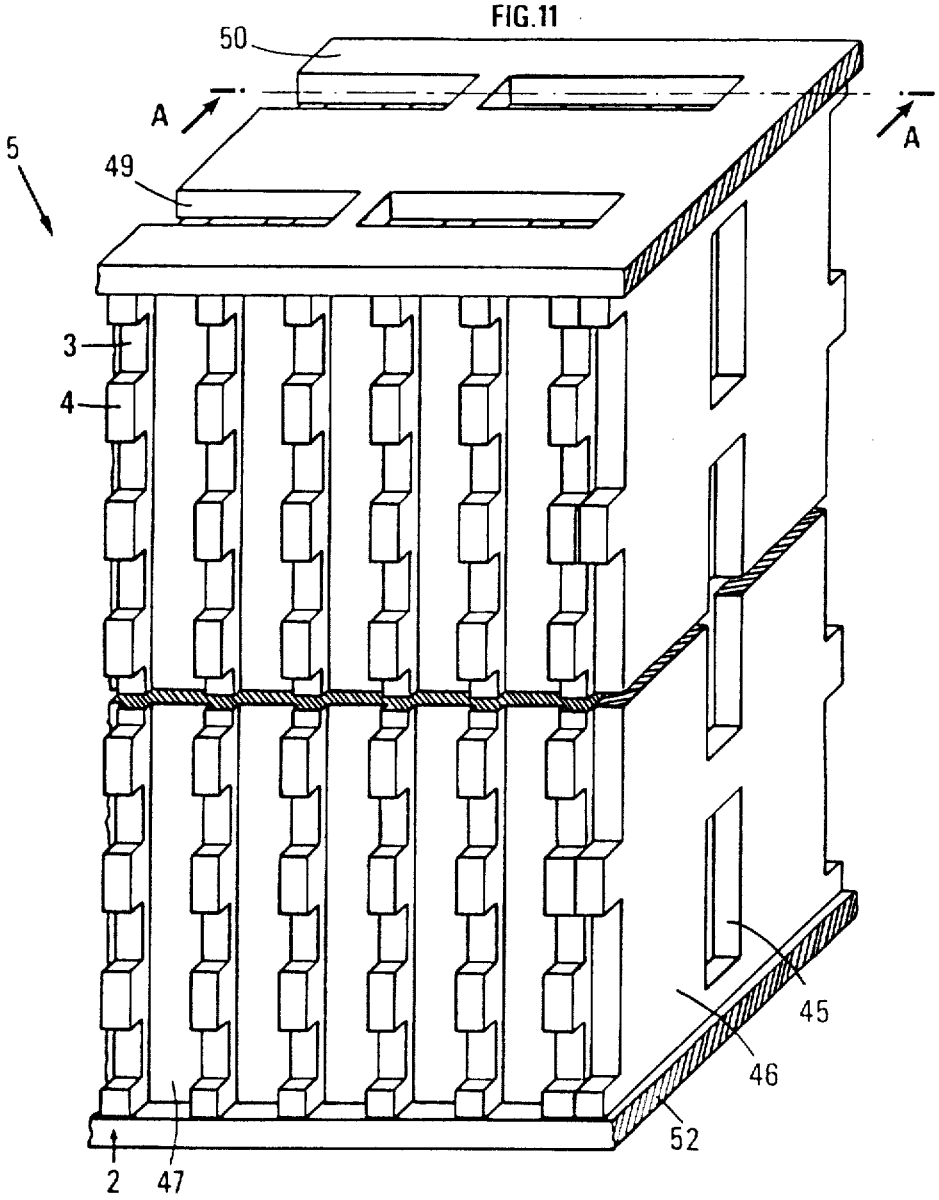
FIG. 11 is a perspective view of an exchanger structure portion in accordance with the invention.

In a first embodiment of a heat exchange zone of the invention, described with reference to FIGS. 1 and lA, plates 1 whose juxtaposition forms said exchange zone (except possibly for the endmost plates), preferably rectangular, carry on each of their face, indented (or crenellated) spacers 2, these spacers, parallel to one another, being further advantageously parallel to the edges of said plates 1 and equidistant all over the width of plates 1. The indentations (or crenels) 3 may have a depth equal to the thickness of the spacers 2 or a smaller depth. This latter possibility is illustrated in FIG. 11. On the spacers 2 of the same face of a plate 1, the indentations 3 may be situated in alignment perpendicularly to the direction of said spacers 2 as shown in FIGS. 1 and lA.

Figure 1A:
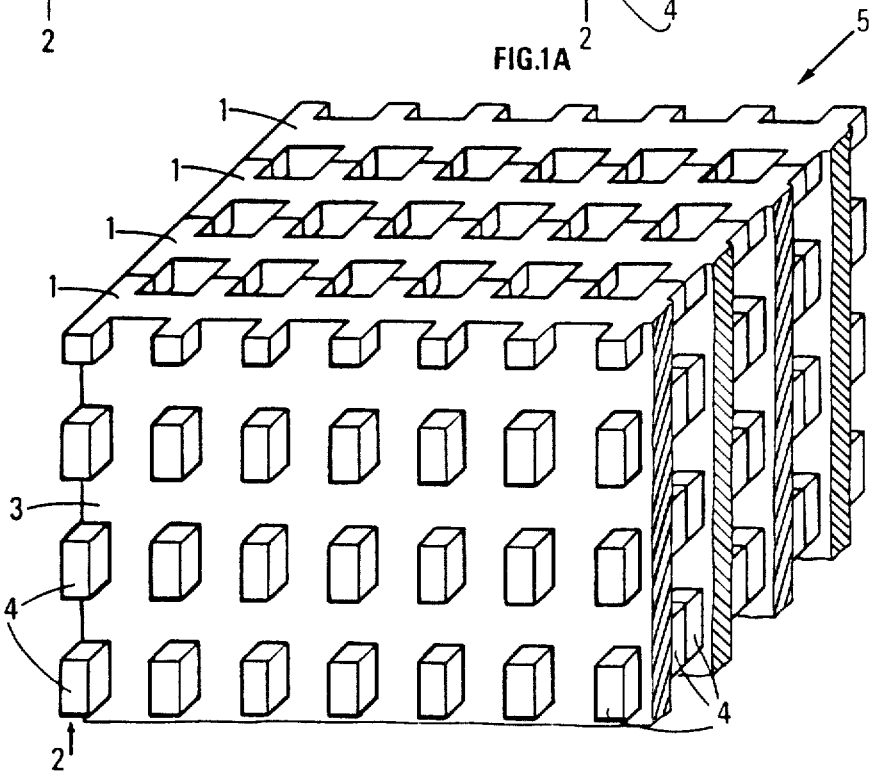
FIG. 1A shows a perspective view of the heat exchanger portion formed by the juxtaposition of a plurality of plates of the type shown in FIG. 1 (four juxtaposed plates have been shown fragmentarily)

Between one face of any plate 1 and the facing face of the adjacent plate 1, the spacers 2 are opposite to each other and their indentations 3 correspond respectively with each other. Thus, the juxtaposition of plates such as 1 brings the projecting parts 4 of the spacers 2 of one face of the plate in contact with the projecting parts 4 of the corresponding spacers 2 of the facing face of the adjacent plate 1. Such a juxtaposition of plates 1 forms an exchange zone 5, such as shown in FIG. 1A, in which the presence of indentations 3 and projecting parts 4 forms between any two adjacent plates 1 a flow network for fluid, each network having a fluid flowing therethrough in a direction parallel to or in a direction perpendicular to the spacers 2. The different adjacent networks are separated, by construction, by the plates 1 themselves, so that between the fluids flowing in adjacent networks there is no possible passage so no risk of leaks.

The structure of the exchange zone 5 offers a large number of flow possibilities for the fluids flowing through the different networks.

Thus, when two fluids are involved, they are each introduced alternately into one flow network out of two.

The two fluids may flow with parallel currents (co-current or counter-currentwise) parallel to the direction of spacers 2. They may also flow in parallel currents (co-current or counter-currentwise) in a direction perpendicular to that of the spacers, through the indentations 3. But the main advantage of the above described structure resides in the fact that the two fluids may flow therein with crossed current, one of the fluids flowing perpendicular to the spacers 2, in one network out of two, the other fluid flowing in the other networks perpendicularly to the spacers 2 through the passages created by the indentations 3.

For providing each of the above flow modes, it is sufficient to close or leave open the networks, on the end faces perpendicular to plates 1, of the exchange zone at suitable positions and to bring the fluids into the networks where they are to flow (or to remove them therefrom) through appropriate openings. That may be provided by affixing on said end faces of the exchange zone 5, plates only comprising the openings required for access to one of the series of flow networks (for introducing the corresponding fluid therein or removing it therefrom), the solid parts of said plates closing the openings corresponding to the other series of networks reserved for flow of the other fluids. These endplates will be described in greater detail further on, with reference to FIGS. 11 and 11A.

Figure 2:
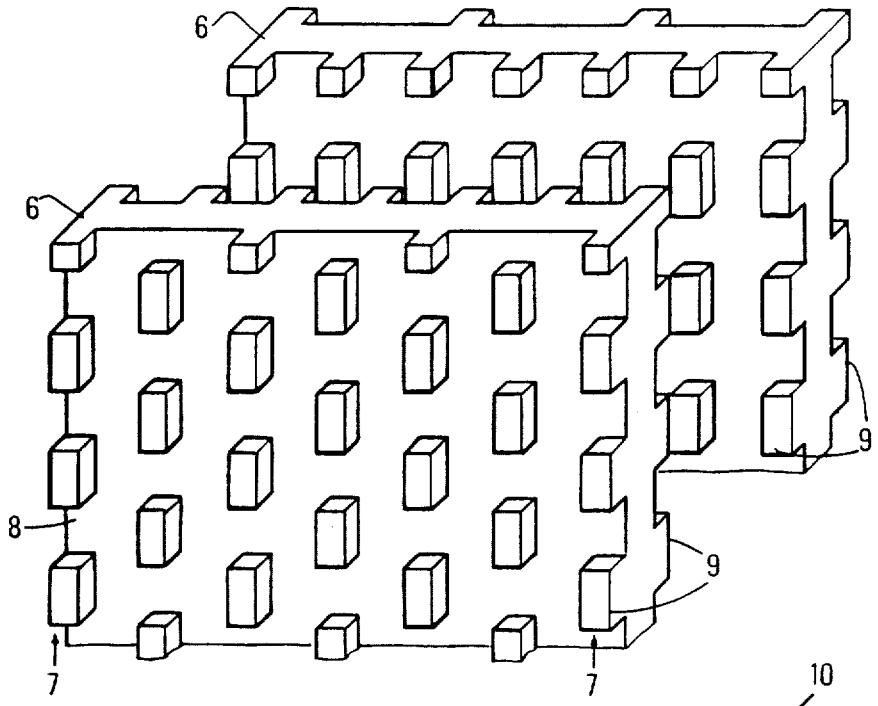
FIG. 2 shows a perspective view of two portions of adjacent plates corresponding to a variant of FIG. 1.
Figure 2A:
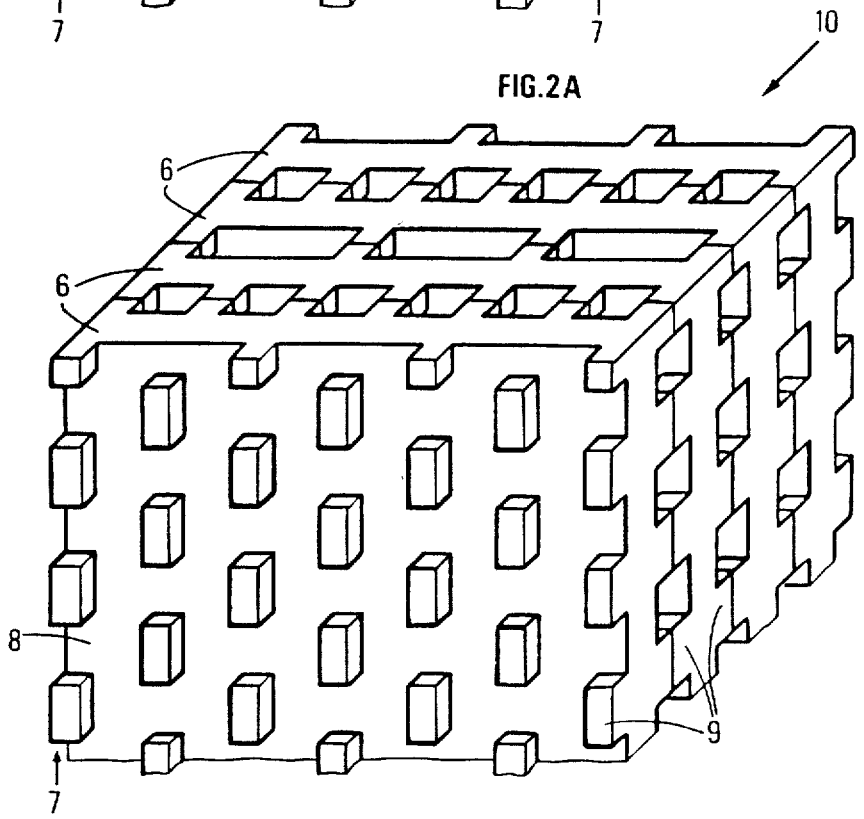
- FIG. 2A shows a perspective view of an exchanger portion formed by the juxtaposition of four plates of the type shown in FIG. 2.

In a variant of the above described embodiment, shown in FIGS. 2 and 2A, the indentations 8 of each of these spacers 7 of the same face of a plate 6 are no longer situated (with respect to one another) in alignment perpendicularly to the direction of the spacers 7, but are offset on two adjacent spacers. In the networks formed by placing in contact the facing faces having such an arrangement of indentations 8, the flow space has a different configuration, so that—more particularly when the fluid flows in a direction substantially perpendicular to spacers 8—its flow follows sinuous paths and does not circulate relatively directly as was the case for plates 1 of FIGS. 1 and lA, where the indentations 3 of the spacers 2 were not offset.

Offsetting of the indentations 8 (and so also of the projecting parts 9), may have a certain regularity; such as shown in FIGS. 2 and 2A, the indentations 8 are offset for one spacer 7 out of two, on the same face of a plate 6. A less regular offset may also be contemplated, being repeated with a periodicity of more than two spacers, or else a quite disordered offset over the whole width of the face of a plate.

In FIGS. 2 and 2A, the staggered arrangement of indentations 8 only relates to one network out of two of the exchange zone 10, but it could also relate to all the flow networks. When the indentations 8 (and the projecting parts 9) of these spacers 7 of each of the both faces of the same plate 6 have staggered arrangements, the "regularity" of the staggering may be different on the one and the other face of the same plate 6.

Figure 3:
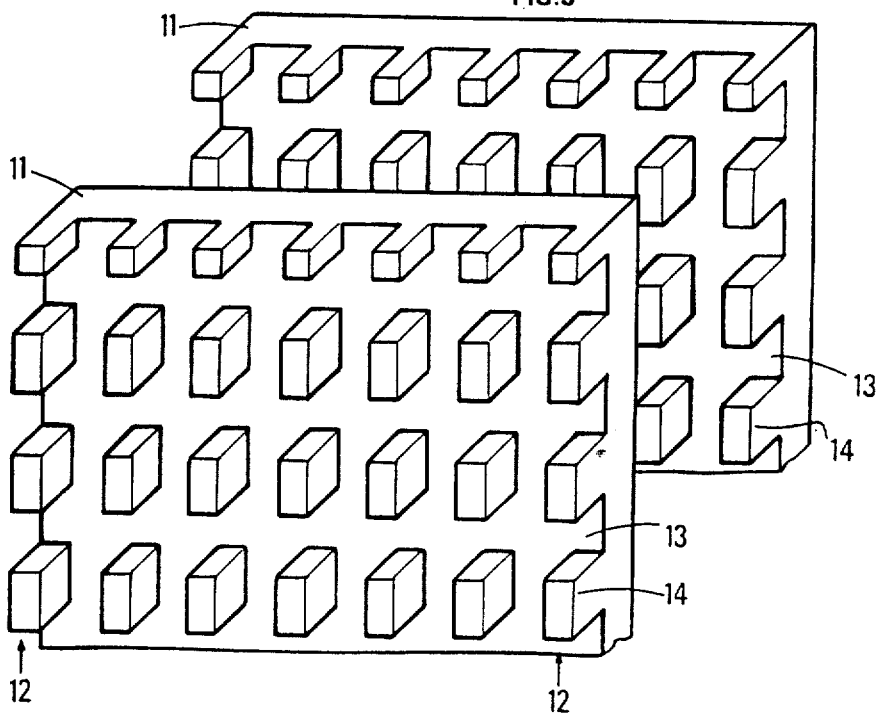
- FIG. 3 shows a perspective view of two adjacent plate portions corresponding to a second variant of the plates of FIG. 1, in which each plate carries spacers (indented) on only one of its faces.

In another variant of the embodiment described above with reference to FIGS. 1 and lA, plates 11, such as shown in FIG. 3, have spacers 12 only on one of their faces, these spacers 12 comprising indentations 13, situated for example in alignment perpendicularly to said spacers 12 of the same plate 11.

During juxtaposition of plates 11 so as to form an exchange zone, the outermost edges (that is to say the projecting parts 14) of the indented spacers 12 of a plate 11 come into contact with the facing face of the adjacent plate 11, said face not comprising any spacers.

The exchange zone once assembled has a geometry similar to that of the exchange zone 5 such as shown in FIG. 1A described above. Similarly, when two fluids are involved, each can be caused to flow in one network out of two, in currents parallel to each other and parallel to the spacers 12, in currents parallel to each other and perpendicular to the spacers 12, or else in crossed currents. It is also possible in another variant, to provide, for all the fluid flow networks or for one network out of two, offsetting or staggering of the indentations 13 between the adjacent spacers 12 of same plate 11, as was described above for plates 6, particularly with reference to FIGS. 2 and 2A.

In a second embodiment of a heat exchange zone of the invention, the plates whose juxtaposition forms said exchange zone (except possibly for the end plates) carry on each of their faces spacers which are, on one of the faces of each plate, solid or continuous spacers, the spacers of the other face of the same plate being indented.

Figure 4:
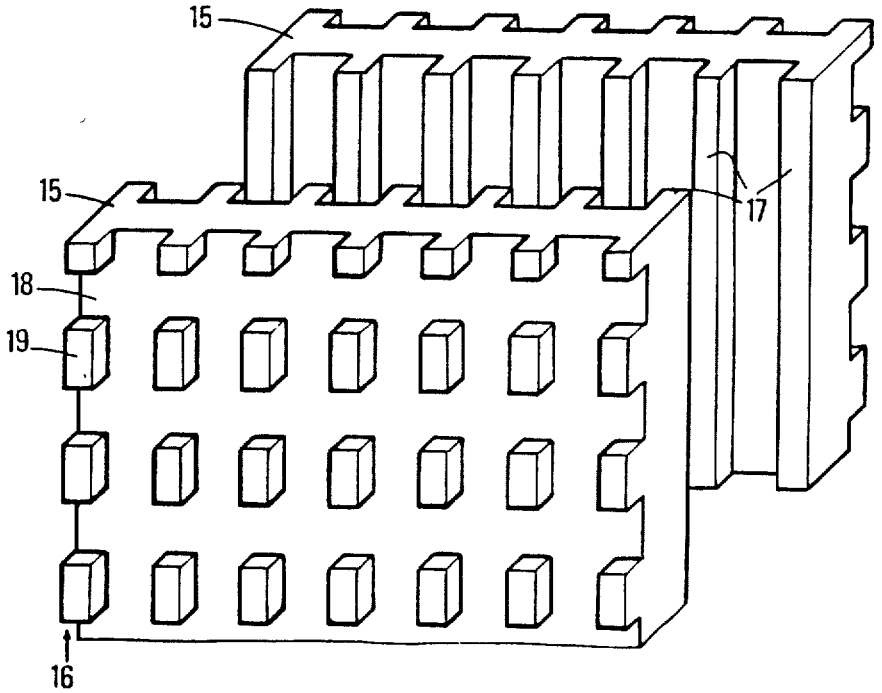
- FIG. 4 shows a perspective view of two adjacent plate portions corresponding to a second particular embodiment in which each plate carries parallel indented spacers on one of its faces and solid parallel spacers on the other face.

Thus, in FIG. 4, plates 15 have on one of their faces indented spacers 16 and on the other face solid spacers 17.

As before, the indentations 18 of the spacers 16 of a face of the same plate 15 may be situated in alignment perpendicularly to said spacers 16 or offset with respect to each other on any two adjacent spacers 16. Advantageously, one face of a plate 15 having solid spacers 17 has opposite a face with solid spacers 17 of the adjacent plate 15, the solid spacers 17 of the facing faces being generally opposite to each other. Similarly, the face of a plate 15 with indented spacers 16 has opposite a face of the adjacent plate 15, itself having indented spacers 16, said spacers 16 being generally opposite to each other, their indentations 18 and their projecting parts 19 corresponding respectively with each other (whether these indentations 18 and these projecting parts 19 are on the same plate 15 in alignment or whether they are offset with respect to each other on any two adjacent spacers).

The juxtaposition of plates 15 forms an exchange zone. The solid spacers 17 of one face of a plate 15 coming into contact over the whole of their length with the corresponding spacers 17 of the facing face of the adjacent 15 form rows of parallel channels which may have flowing therethrough one of the fluids involved, parallel to the spacers 17. Moreover, the fact that the projecting parts 19 of the indented spacers 16 of facing faces of two adjacent plates come into contact means that a flow network is formed for a second fluid. The assembly of networks may have said second fluid flowing therethrough in a direction parallel to the spacers 16 (in this case, the two fluids flow in parallel currents: in co-current or counter-current fashion) or in a direction perpendicular to the spacers 16 through the passages created by the indentations 18 (in this case, the two fluids flow in crossed currents).

In the second embodiment described above, it is also possible, as described in one of the variants of the first embodiment, to juxtapose plates which only have spacers on one of their faces. In the present case, it may be contemplated that, for one plate out of two, the spacers are solid and, for the other plates the spacers are indented. The juxtaposition of such plates allows an exchange zone to be formed having a geometry similar to that of the exchange zone obtained by juxtaposition of plates such as 15 shown in FIG. 4 having an alternation of flow networks for one of the fluids and rows of channels for the other fluid.

This arrangement is not shown by a figure.

In a variant which relates equally to the first or to the second embodiment of the heat exchange zone of the invention, said exchange zone may be formed by the alternative juxtaposition of plates with spacers (crenellated or continuous) on both their faces and plates having no spacers.

Other variants may also be contemplated for the arrangement and configuration of the spacers carried by the elementary plates whose juxtaposition forms an exchanger structure of the invention provided that, in accordance with the general definition of the invention, the spacers indented or solid, are parallel with each other and are disposed on the faces of the plates so that at least one part of the spacers of one face of a plate comes into contact with the facing face of the adjacent plate or with at least a part of the spacers of the facing face of the adjacent plate, (the two adjacent plates being, in this juxtaposition, parallel with each other), thus defining flow spaces for the two fluids to be placed in heat exchange relation and so that, for at least one flow space out of two, the spacers carried by one and/or the other of the facing faces of the two adjacent plates defining said space are crenellated spacers.

Figure 5:
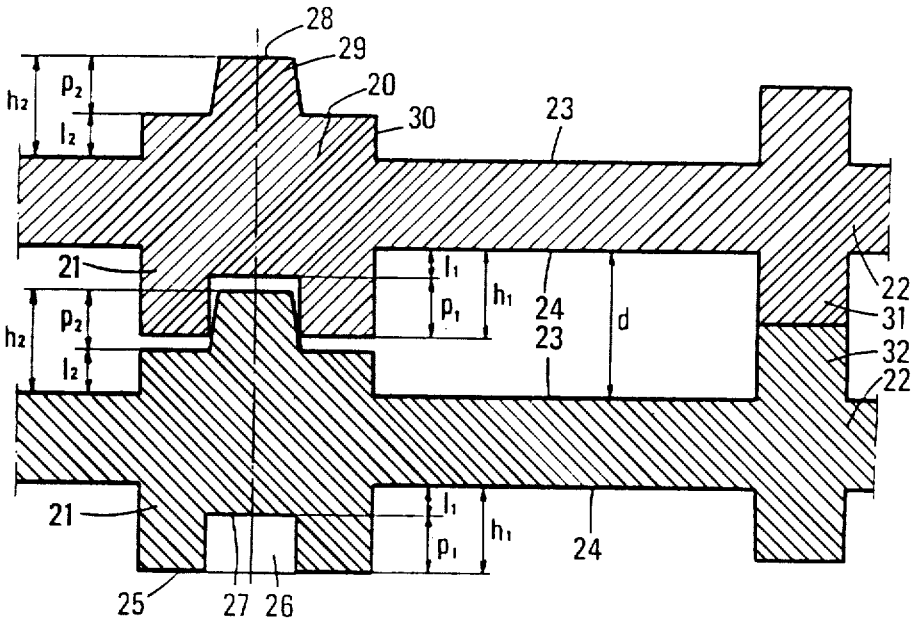
- FIG. 5 shows in section a way of positioning two adjacent plates by means of studs.

The positioning of the adjacent plates in a plane parallel to the plane of said plates may be provided by causing male and female studs such as 20 and 21, shown in FIG. 5, to correspond (these studs such as 20 and 21 being integral with the adjacent plates 22 and disposed respectively on the faces 23 and 24 of said plates), each male stud 21 of a face 23 or a plate 22 being opposite a female stud 21 of the facing face 24 of the adjacent plate 22, in the juxtaposition of the plates.

A female positioning stud 21 may consist for example of a volume (for example of cylindrical or parallelepipedic shape), projecting over a height $h_1$ from the face 24 of the plate 22 which carries it, whose end section plane 25 is advantageously parallel to said face 24, and which has a cavity 26 (for example of cylindrical or parallelipipedic shape whose axis and/or walls have a direction perpendicular to said face 24) open on the face of the stud opposite the plate, i.e. on section 25. When the depth $p_1$ of cavity 26 is less than the height $h_1$ of the female stud, the bottom 27 of the said cavity 26 is at a distance $l_1$ from the face 24 of plate 22.

A male positioning stud 20 may consist of a volume projecting over a height $h_2$ from the face 23 of the plate 22 which carries it, whose end section plane 28 is advantageously parallel to said face 23 and at least a part 29 of which, of height $p_2$, less than or equal to the total height $h_2$ of the stud, has a suitable shape (for example a truncated cone or truncated pyramid shape) so as to be able to engage in the cavity 26 of the female stud 21 which faces it. The male stud 20 may comprise a base 30, for example of parallelipipedic or cylindrical shape, of height $1_2 = h_2 - p_2$.

The dimensions and the shape of the male and female studs 20 and 21, in particular the slope of the truncated cone or truncated pyramid shaped surface of part 29 of the male stud 20, are chosen so that the positioning of the adjacent plates, at a distance determined by the heights of spacers 31 and 32, has the least play possible.

Thus, for example, with spacers 31 and 32 in contact, the end plane 25 of the female stud 21 may come into contact with the end plane of the base 30 of the male stud 20, when such a base exists, or with the face 23 of the plate, when there is no base, i.e. when $p_2=h_2$. We then have the relationship: $h_1+l_2=d$ or $h_1+h_2-p_2=d$ or else, if the heights $h_1$ and $h_2$ are given, $p_2=h_1+h_2-d$, where d is the distance between facing faces of adjacent plates.

So as to reduce as much as possible the possibility of play between the plates, the dimensions of the inner edge of the cavity 26 of the female stud 21 should be identical to the dimensions of the truncated cone or truncated pyramid shaped part 29 of the male stud 20 at its junction with base 30 (or with the face 23 of the plate when there is no base).

Furthermore, it is preferable for the endplane 28 of the truncated cone or truncated pyramid shaped part 29 of the male stud 20 not to be in contact with the bottom of the cavity 26 of the female stud 21; and we have $p_2<p_1$ or $h_2+l_1<d$.

The contact between the male stud 20 and the female stud 21 may also be provided by contacting of the end plane 28 of the male stud 20 with the bottom 27 of the cavity 26 of the female stud 21. We then have: $h_2+1=d$ or $h_2+h_1-p=d$ or else, if the heights $h_1$ and $h_2$ are given, $p_1=h_1+h_2-d$.

To reduce the possibility of play as much as possible between the plates, in this case, the dimensions of the inner edge of the cavity 26 of the female stud 21 should be identical to those of the section of the truncated cone or truncated pyramid shaped part 29 of the male stud 20 at the same level, it being understood that it is further preferable for there to be no contact between the endplane 25 of the female stud 21 and the endplane of the base 30 of the male stud 20, when such a base exists, or with the face 23 of the plate when there is no base. We have then $p_1<p_2$ or $h_1+l_2<d$.

However, the most advantageous case is one where the contact between the male studs 20 and the female studs 21 is provided neither by contacting of the end plane 25 of the female stud 21 with the base 30 of the male studs 20, nor by contacting of the end plane 28 of the male studs 20 with the bottom 27 of the cavity 26 of female studs 21, but by contacting the inner edge of the cavity 26 of the female studs 21 with the truncated cone or truncated pyramid shaped part 29 of the male studs, at an intermediate level thereof, where the dimensions coincide. In this arrangement, there is no possible lateral play between the plates. It is the one which is shown by FIG. 5.

The relationships which govern this arrangement are the following:

$h_1+l_2<d$, or $h_1+h_2-p_2<d$ on the one hand $h_2+1_1<d$, or $h_2+h_1-p_1<d$ on the other.

and, if the heights $h_1$ and $h_2$ are given (as well as the distance d), $p_2>h_1+h_2-d$ $p_1>h_1+h_2-d$ On the other hand, no relationship of inequality between $p_1$ and $p_2$ may be established ; they could if required be equal.

The positioning studs 20 and 21 may be distributed in any way on the faces of each plate 22, with the condition that to each male stud 20 of a face 23 of any plate 22 there corresponds a female stud 21 on the facing face 24 of the adjacent plate 22.

On the faces of each of the juxtaposed plates 22 in an exchanger structure of the invention, the positioning studs 20 and 21 (male or female respectively) may be placed between the spacers or on the spacers themselves.

The male and female positioning studs considered in the invention may have other forms than those described above. They will be equivalent to studs 20 and 21 when they fulfill the same function which consists in preventing the plates from moving with respect to each other in a plane parallel to the plane of the plates.

Figure 12:
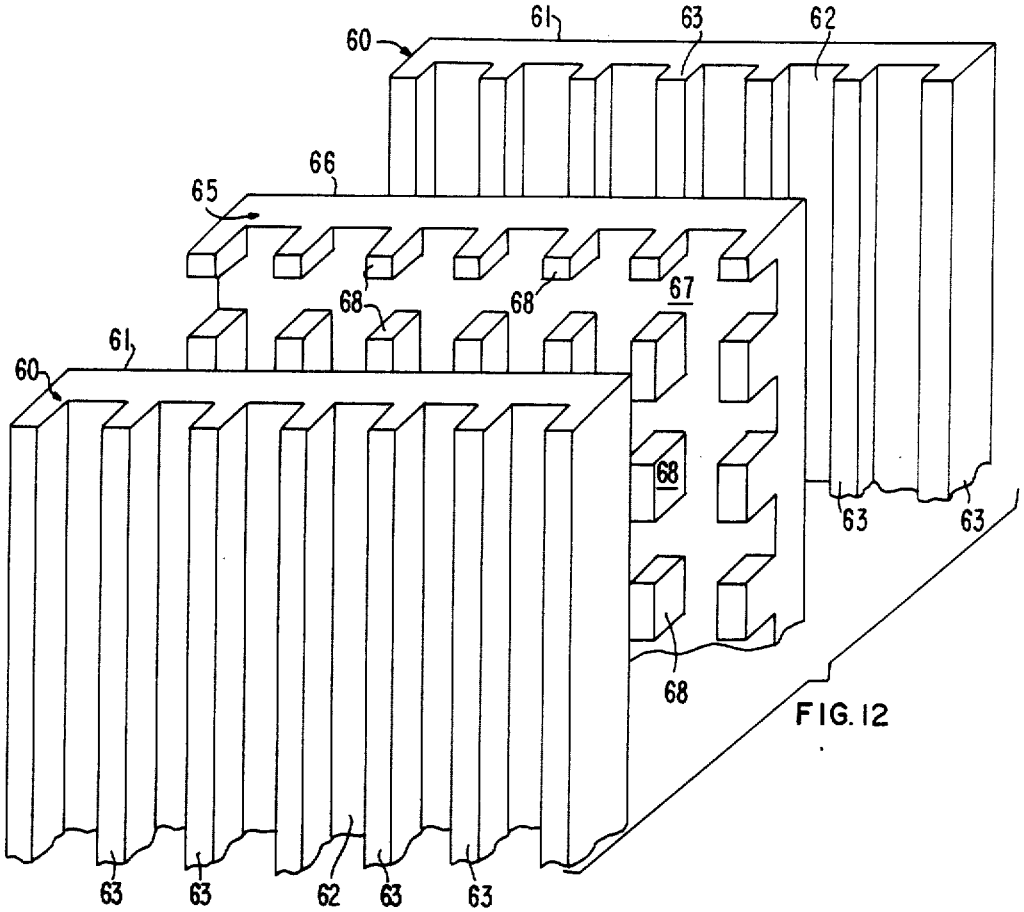
FIG. 12 is perspective view showing three adjacent plate portions corresponding to an embodiment of the invention wherein the plates are alternated with one type of plate having crenelated spacers thereon and the other type of plate having continuously extending ribbed spacers thereon.
Figure 13:
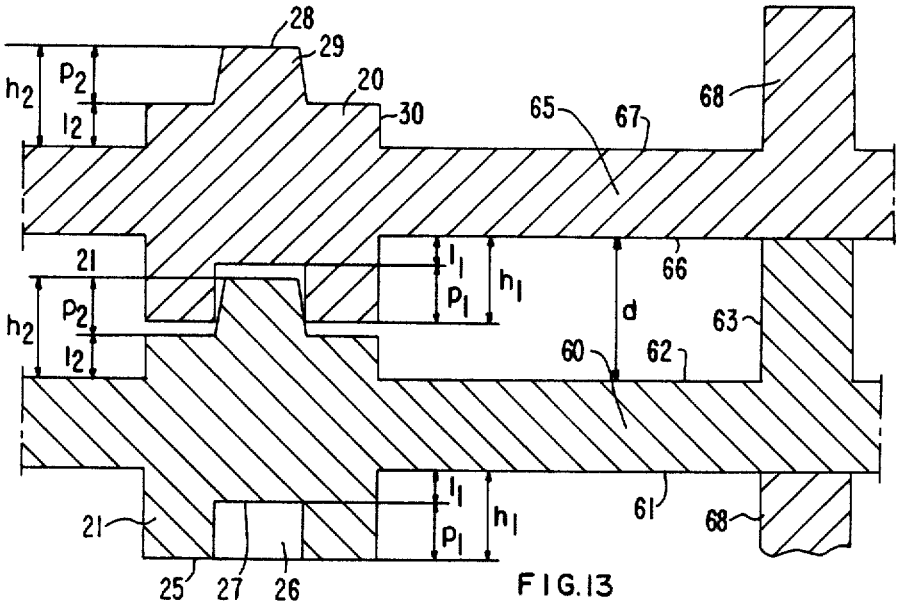
FIG. 13 is a view similar to FIG. 5, but showing spacers directly abutting the planar surface of adjacent plates.

FIG. 13 is similar to FIG. 5 but shows crenellated spacers 63 abutting the rear surface 66 of the adjacent plate 65 and continuously extending rib spacers 68 abutting the rear surface 61 of plates. In FIG. 13, the structure of FIG. 12 is shown in combination with the structure of FIG. 5.

The juxtaposed plates which form the exchange zone of the device of the invention may be maintained against each other by any known clamping means, for example, by means of end flanges connected and clamped together by tie-rods passing to the outside of the block forming the exchange structure.

Figure 6A:
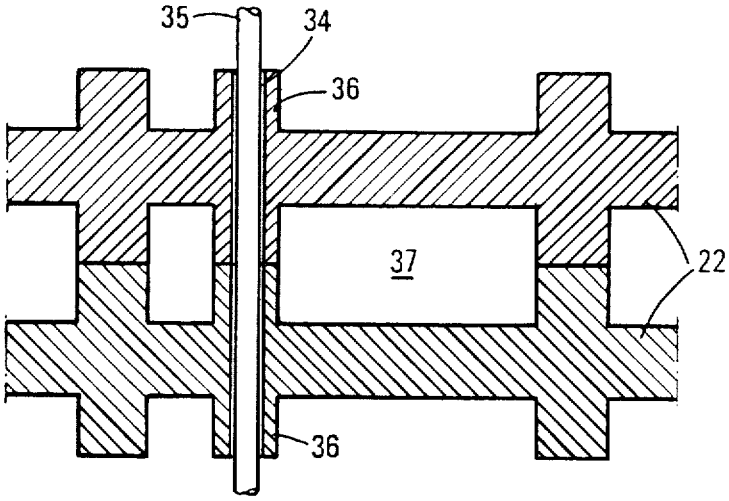
- FIG. 6A shows in section, on two plate portions, a system for assembling the whole of the juxtaposed plates

However, so as to obtain better distribution of the clamping pressures over the whole extent of the plates, it is preferable, as shown in FIG. 6A, to provide the passage through plates 22, through openings 34 formed perpendicularly to the surface of said plates 22 and all positioned at homologous points of said juxtaposed plates, of tie-rods 35 formed for example by metal rods threaded at their ends, these ends passing, on each side of the block forming the exchange structure through flanges preferably made of metal and pierced with openings corresponding to the openings 34 pierced in plates 22, clamping of the assembly formed by the flanges and the exchange structure which they enclose being provided by means of nuts screwed on to the threaded ends of the rods forming the tie-rods 35.

Since the openings 34 allowing passage of the above described tie-rods 35 may be the cause of leaking of a fluid (for example relatively cold) into the other fluid (relatively hot) through the plates 22, said openings may be, in a particular arrangement of the invention, formed through parts of the plates specially designed for ensuring, during clamping of the assembly of the plates the sealing between the flow spaces of the fluids situated on each side of each plate. Thus, in FIG. 6A, the openings 34 formed in plates 22, are provided with sleeves 36 having a geometry such that their endmost edges come into contact during clamping of the assembly of plates 22, thus preventing the fluid from passing through the openings 34 from one flow space 37 to the adjacent flow space 37. With this arrangement repeated over the whole extent of the exchange block, the limitation of leaks between all the flow spaces situated on each side of the plates is thus provided.

The openings 34 for passing the tie-rods 35 therethrough, may be distributed in any way over the surface of plates 22. The distribution is preferably relatively regular.

Figure 6B:
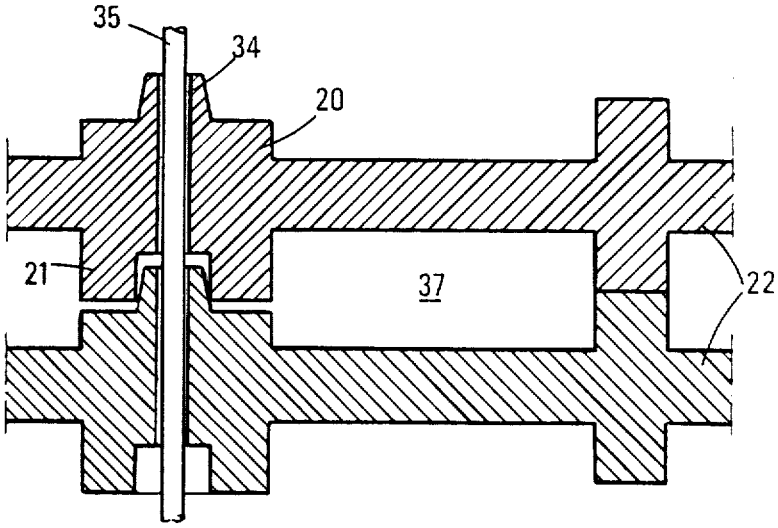
FIG. 6B shows in section, on two plate portions, a preferred embodiment of such a system.

In a preferred arrangement shown in FIG. 6B, the openings 34 for the passage of tie-rods 35 may be formed through the positioning studs 20 and 21 such as is described above, whose geometry must then be such that they provide both positioning of the plates 22 with respect to each other and limitation of the leaks between the flow spaces 37 for the fluids on each side of plates 22, this limitation of leaks being provided by contacting between the male and female parts of the positioning studs.

An exchanger structure of the invention may be formed by the juxtaposition of a number of plates such as already described. However, each plate may also be formed by assembling several elementary plates in the same plane, the plates to be assembled then being provided, on their respective edges, with suitable fixing devices, the assembly being provided by mutual fitting together of said fixing devices. Thus, a number m of elementary plates may be assembled together by their edges perpendicular to the direction of the spacers and/or a number n of elementary plates may be assembled together by their edges parallel to the direction of the spacers, this forming plates comprising m x n elementary plates, m and n being any whole numbers (one at least of which is at least 2). In general, the numbers m and n are not very high.

Figure 8:
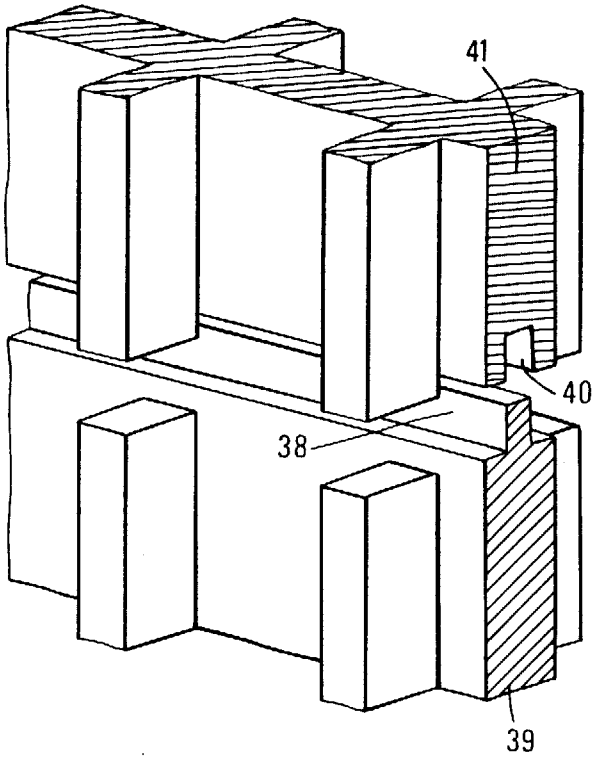
FIG. 7 and 8 show in perspective two ways of assembling elementary plates in the same plane along an edge perpendicular to the direction of the spacers.
Figure 7:
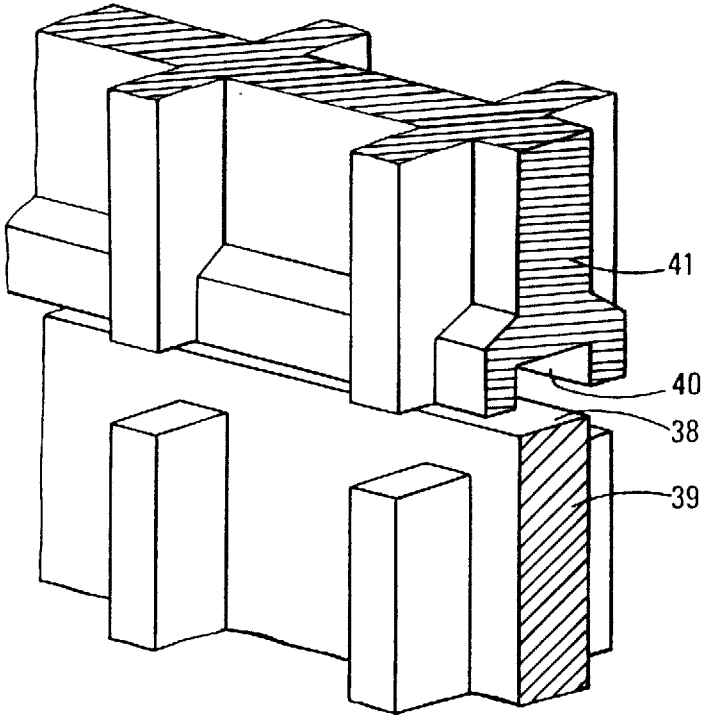

The lateral assembling of the plates along their edges perpendicular to the direction of the spacers may be provided for example by means of devices such as those shown in FIG. 7 and 8 or by equivalent devices.

The assembling devices, shown in FIGS. 7 and 8, are based on the same principle which consists in fitting a projecting part or tongue 38 of the edge of one of the plates to be assembled 39 into the corresponding hollow part or groove 40 formed on the edge of the adjacent plate to be assembled 41. Said projecting part 38 has the same thickness as plate 39 in FIG. 7 and a smaller thickness in FIG. 8.

Figure 9:
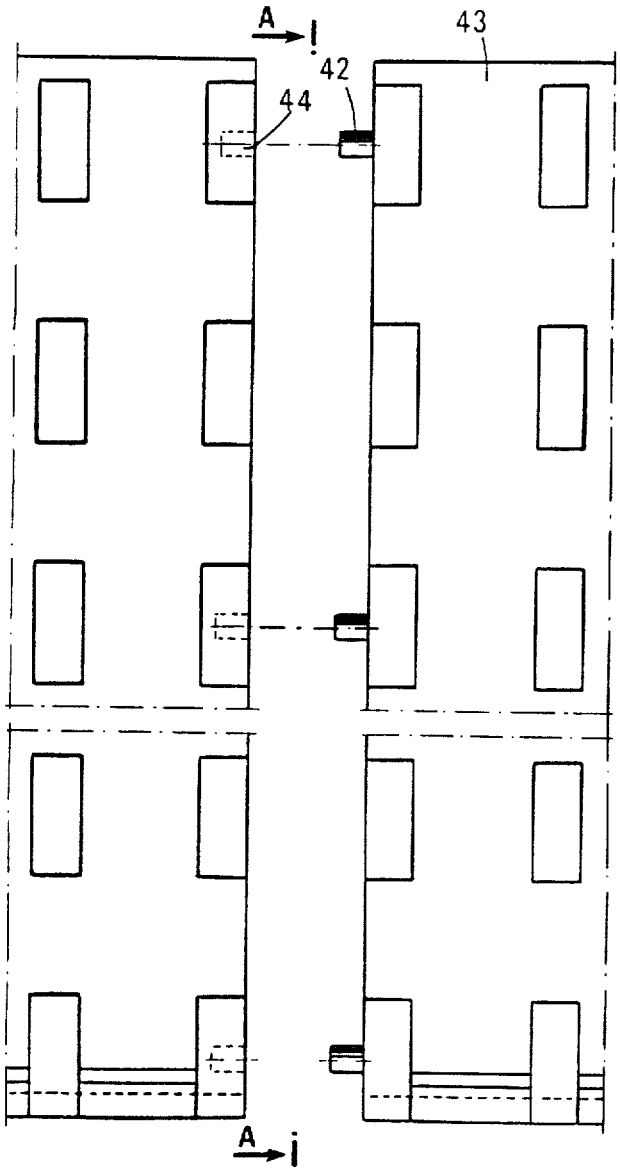
FIGS. 9 and 9A showed a way of assembling elementary plates in the same plane, along an edge parallel to the direction of the spacers.
Figure 9A:
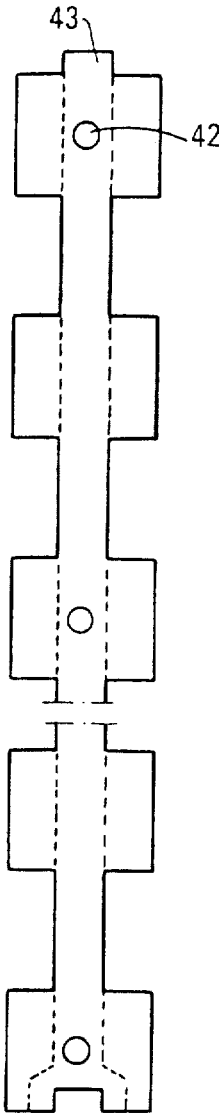

The lateral assembling of the plates along their edges parallel to the direction of the spacers may be provided, for example, as shown in FIGS. 9 and 9A, by fitting studs 42 projecting from the edge of a plate 43 into holes 44 practically of the same dimension formed in the edge of the adjacent plate to be assembled, opposite said studs 42.

An important advantage of the exchanger structures of the invention is that they offer a large number of possibilities of use.

Figure 10A:
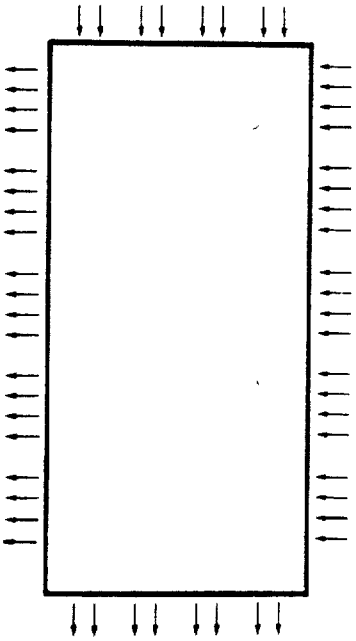

Among the possibilities of use may be mentioned principally the one which consists in creating an exchange relationship between two fluids flowing in crossed currents, such as shown schematically in FIG. 10A.

To form such a structure, a block is generally used formed by juxtaposition of plates which may correspond to the different types described above, except for those in which the spacers are continuous in all the spaces situated between adjacent plates. A particular embodiment is shown in FIGS. 11 and 11A.

Figure 11A:
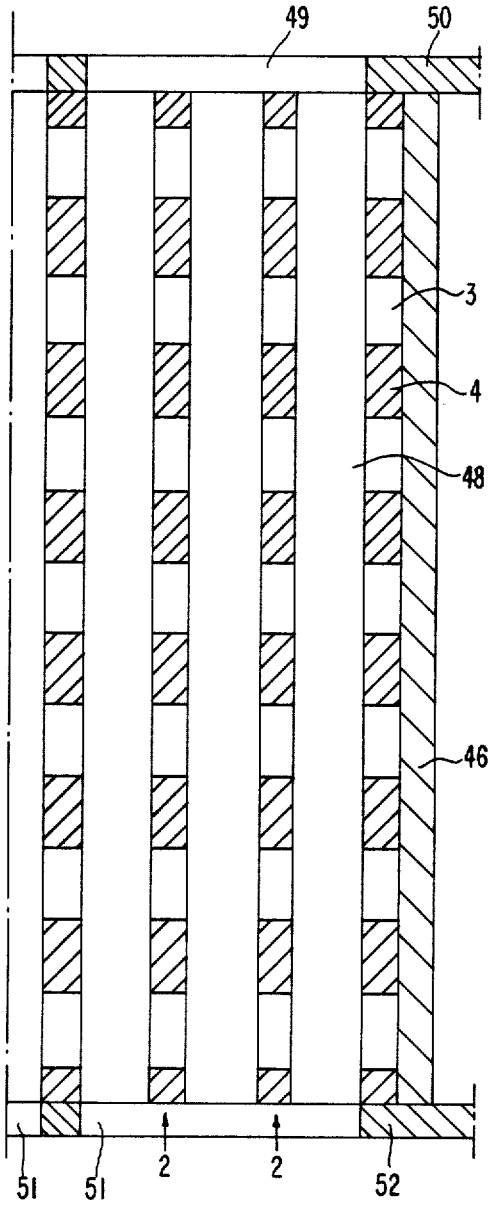
- FIG. 11A is a sectional view of FIG. 11 through plane A—A.

The fluid to flow generally in a direction perpendicular to the spacers 2 may be introduced through openings 45 in plate 46, these openings giving access to the spaces 47, the plate 46 further closing the spaces intended for flow of the second fluid (spaces 48 of the section shown in FIG. 11A).

The fluid is generally discharged through the face of the exchange block opposite the intake face, through openings similar to openings 45 in a plate similar to plate 46 (not shown in FIGS. 11 and 11A), said plate also closing the spaces 48 intended for flow of the second fluid.

As for the fluid which is to flow in spaces 48, in a general direction parallel to the spacers 2 of FIG. 11A, it may be introduced through the openings 49 in plate 50, these openings giving access to the spaces 48, said plate 50 further closing the spaces 47 intended for flow of the first fluid.

The said second fluid is removed through the face of the exchange block opposite the intake face, through openings 51 in plate 52, said plate also closing off the spaces 47 for circulation of the first fluid.

If we assume that plates whose juxtaposition forms the exchange block considered in FIGS. 11 and 11A are situated in vertical planes, the intake plates 46 and the discharge plates (not shown) for the first fluid will themselves be situated in vertical planes, orthogonal to the preceding ones, the intake plates 50 and the discharge plates 52 for the second fluid will be in horizontal planes and the second fluid will flow from top to bottom. The second fluid may just as well flow from bottom to top, the intake plate then being the lower plate 52 and the discharge plate then being the upper plate 50.

Instead of causing the second fluid to flow through spaces such as 48 (in FIG. 11A) communicating through the indentations 3 formed in spacers 2, it may also be caused to flow in separate channels, using plates having on one of their faces solid spacers, similar to plates 15 of FIG. 4.

Figure 14:
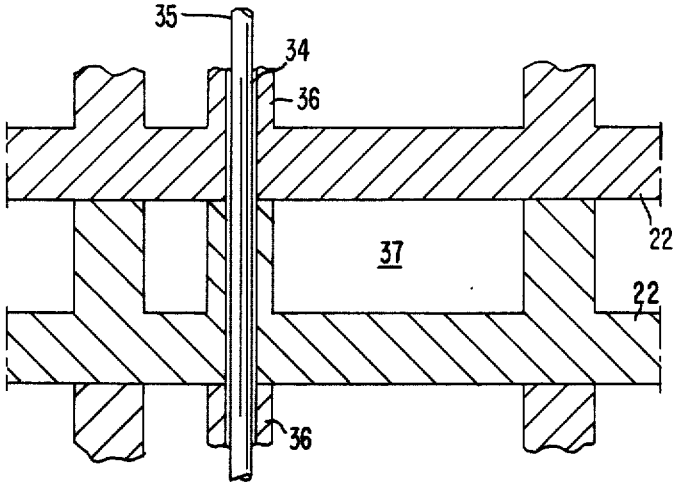
FIG. 14 is a view similar to FIG. 6*a*, but showing spacers directly abutting the planar surface of adjacent plates.
Figure 15:
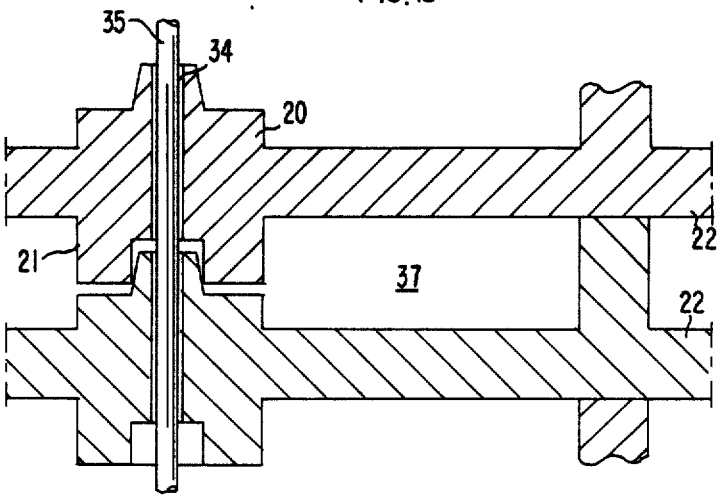
FIG. 15 is a view similar to FIG. 6*b*, but showing spacers directly abutting the planar surface of adjacent plates.

FIG. 12 shows another embodiment of the invention wherein two types of plates are used to make the heat exchanger. The first type of plate, plate 60, has a planar surface 61 and a ribbed surface 62, wherein the ribbed surface 62 has rows of parallel spacers 63 similar to the parallel spacers 17 of FIG. 4. The second type of plate, plate 65, has a planar face 66 and a crenellated face 67 having a plurality of space projections 68 thereon which correspond to the crenellated projections 4 shown in FIGS. 1 and 14 shown in FIG. 3. With the arrangement of FIG. 12, the ribs 63 and crenellated projections 68 abut the flat surfaces 66 and 61' of adjacent plates.

Figure 10B:
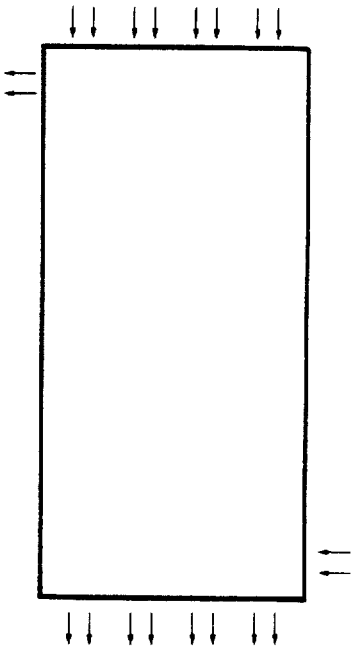

Another possibility of forming the exchanger structures of the invention is shown schematically by figure 10B. The exchange block comprises three zones whose role may be defined in relation with the flow of the first fluid (fed laterally), since the second fluid flows in the same way in the three zones, namely parallel to the direction of the spacers whether this is from bottom to top or (as shown in FIG. 10B) from top to bottom. In the lower zone, which is for example the zone for intake of the first fluid, this latter flows substantially in crossed current fashion with the second fluid. In the central zone, the two fluids flow in parallel currents (counter-currentwise if the second fluid flows from top to bottom or co-currentwise if the second fluid flows from bottom to top), and in the upper zone, which is in the case considered the zone for discharge of the first fluid, this fluid flows substantially in crossed-current relation with the second fluid. To obtain operation of this type, it is sufficient, in the intake (respectively discharge) plate for the second fluid, to form openings necessary for the introduction (respectively for the discharge) of said fluid solely in the lower part (respectively in the upper part) of the plate considered.

The dimensioning of the exchanger structures of the invention may be very varied depending on the flow-rates and temperatures of the fluids placed in exchange relation. The length and width of the plates may be several tens of centimetres, their thickness from at least 1 millimetre to a few millimetres and the distance between the median planes of adjacent plates may be from a few millimetres to a few centimetres. The number of plates juxtaposed for forming the exchange block may be from about 10 to several hundreds.

The exchange area per unit of volume of the devices of the invention may be high. Average values of this area are in the vicinity of 150 to 200 m2 per $m^3$.

The plates forming the exchanger structures of the invention may be made from various materials, good or average heat conductors, depending on the temperatures of the fluids taking part in the heat exchange.

The material may consist of a thermoplastic material such as polypropylene, possibly reinforced, for temperatures less than 100° C., polyvinylidene fluoride for temperatures going for example from 100° to 140° C., or else a reinforced ethylene-tetrafluorethylene copolymer for temperatures going for example from 140° to 190° C.

The plates may also be formed from thermosetting plastic materials such for example as polyesters or epoxy resins.

The material may also consist of a metal, a metal alloy, glass, cement or ceramic. It may further consist of a composite material such, for example, as a plastic material, reinforced with powdery, granular, filament, woven or non-woven products or reinforcements, said products or reinforcements themselves consisting, for example, of metals, alloys, amorphous carbon, graphite, glass, ceramic or else mineral salts.

Depending on the material forming the exchanger of the invention, its area per unit of mass may be situated about 6 to 7 dm2/kg for steel and about 40 to 50 dm2 for a plastic material.

The plates may be obtained by different methods. In particular, when the material is a light alloy, a thermoplastic material or a thermosetting material, they may be formed by molding (particularly injection molding) are The heat exchange devices of the invention are further provided with intake and discharge ducts for each of the fluids participating in the exchange, these ducts being connected to the exchange structure properly speaking by conventional means which will not be described in detail.

They may be used for heat exchanges between gases, in particular for recovering heat from smoke (from boilers, furnaces, etc.), the heat recovered serving more particularly for heating the air (for example for preheating the combustion air of a boiler or furnace).

What is claimed is:

1. A device for the exchange of heat between first and second fluids, one being relatively hot and other being relatively cold, comprising a heat exchange zone and intake and discharge means connected to sources of each of said fluids for letting fluid in and discharging fluid from the heat exchange zone, wherein said heat exchange zone comprises at least one block formed by juxtaposition of a plurality of solid, rectangular, heat exchange-block-forming plates extending parallel with one another with each plate having opposed faces and with one face of each plate being planar; at least some of the plates being provided on only one face with crenelated spacing elements extending parallel with respect to one another and in spaced relation with one another on the same plate and with other of the plates having continuously extending spacers on only one face thereof with all continuously extending spacers extending in parallel from one plate to an adjacent plate; said plates being formed and disposed so that for any two adjacent plates one of the faces on one plate is provided with said crenelated spacing elements and one of the faces on the other of said plates is provided with said continuously extending spacers; the crenelated spacing elements and continuously extending spacers, each having flat surfaces abutting the planar face on the adjacent plate; said exchange zone further comprising first end plates disposed perpendicularly to the exchange-block-forming plates and extending parallel to the direction of extent of the continuously extending spacers, the first end plates being provided with openings for intake and discharge of the first fluid into and out of flow spaces provided by the crenelated spacing elements and second end plates disposed perpendicularly to the exchange-block-forming plates and perpendicular with respect to the direction of extent of the continuously extending spacers, the second end plates being provided with openings for intake and discharge of the second fluid into and out of flow spaces provided by the continuously extending spacers, said juxtaposed plates forming the exchange block being held clamped between two flanges by tie-rods formed from rods threaded at their ends passing through the assembly of plates through openings provided with sleeves distributed in spaced relation over the whole surface of said plate.

2. A device for the exchange of heat between first and second fluids, one being relatively hot and other being relatively cold, comprising a heat exchange zone and intake and discharge means connected to sources of each of said fluids for letting fluid in and discharging fluid from the heat exchange zone, wherein said heat exchange zone comprises at least one block formed by juxtaposition of a plurality of solid, rectangular, heat exchange-block-forming plates extending parallel with one another with each plate having opposed faces and with one face of each plate being planar; at least some of the plates being provided on only one face with crenelated spacing elements extending parallel with respect to one another and in spaced relation with one another on the same plate and with other of the plates having continuously extending spacers on only one face thereof with all continuously extending spacers extending in parallel from one plate to an adjacent plate; said plates being formed and disposed so that for any two adjacent plates one of the faces on one plate is provided with said crenelated spacing elements and one of the faces on the other of said plates is provided with said continuously extending spacers; the crenelated spacing elements and continuously extending spacers, each having flat surfaces abutting the planar face on the adjacent plate; said exchange zone further comprising first end plates disposed perpendicularly to the exchange-block-forming plates and extending parallel to the direction of extend of the continuously extending spacers, the first end plates being provided with openings for intake and discharge of the first fluid into and out of flow spaces provided by the crenelated spacing elements and second end plates disposed perpendicularly to the exchange-block-forming plates and perpendicular with respect to the direction of extent of the continuously extending spacers, the second end plates being provided with openings for intake and discharge of the second fluid into and out of flow spaces, each plate including on one face thereof a plurality of male positioning elements and on the other face thereof a plurality of female positioning elements, the plates being positioned with the male positioning elements of each plate being received within the female positioning elements of a plate adjacent one face of the plate and with the female elements of each plate receiving the male elements of the plate, said male and female members having bores therethrough, and tie rods for holding the block together passing through the bores in the male and female members.

* * * * *